US007373884B2

(12) United States Patent
Haeselich

(10) Patent No.: US 7,373,884 B2
(45) Date of Patent: May 20, 2008

(54) RAPID-FIRE WEAPON

(75) Inventor: Detlef Haeselich, Muessen (DE)

(73) Assignee: Nico-Pyrotechnik Hanna-Juergen Diederichs GmbH & Co. KG, Trittau (DE)

( * ) Notice: Subject to any disclaimer, the term of this patent is extended or adjusted under 35 U.S.C. 154(b) by 11 days.

(21) Appl. No.: 10/556,022

(22) PCT Filed: May 6, 2004

(86) PCT No.: PCT/DE2004/000952

§ 371 (c)(1),
(2), (4) Date: Dec. 1, 2005

(87) PCT Pub. No.: WO2004/102107

PCT Pub. Date: Nov. 25, 2004

(65) Prior Publication Data

US 2007/0011931 A1 Jan. 18, 2007

(30) Foreign Application Priority Data

May 8, 2003 (DE) ..... 103 20 731

(51) Int. Cl.
*F42B 12/58* (2006.01)

(52) U.S. Cl. ..... 102/438; 102/217; 89/135

(58) Field of Classification Search ..... 102/338, 102/345, 352, 360, 335, 438, 217; 86/20.1; 42/84; 89/20.1, 135
See application file for complete search history.

(56) References Cited

U.S. PATENT DOCUMENTS 2,897,757 A * 8/1959 Kulluck ..... 102/438
3,412,681 A 11/1968 Schirneker
3,421,244 A 1/1969 Reed
3,686,999 A * 8/1972 Francois ..... 89/1.1
4,791,870 A * 12/1988 Simpson ..... 102/342
4,878,432 A 11/1989 Mikhail
5,623,113 A * 4/1997 Valembois ..... 89/1.817
6,123,007 A 9/2000 O'Dwyer
6,138,395 A 10/2000 O'Dwyer
6,510,643 B2 * 1/2003 O'Dwyer ..... 42/84
6,659,012 B1 * 12/2003 Grassl et al. ..... 102/336

(Continued)

FOREIGN PATENT DOCUMENTS

DE 38 79 918 T2 12/1988

(Continued)

*Primary Examiner*—Michael J. Carone
*Assistant Examiner*—Benjamin P Lee
(74) *Attorney, Agent, or Firm*—Milde & Hoffberg, LLP

(57) ABSTRACT

A rapid-fire weapon has a barrel with a projectile insertable into the barrel, which comprises several sub-projectiles disposed one behind the other in the longitudinal direction of the barrel and supporting each other. A propellant charge and an ignition means are provided behind each sub-projectile for the sequential ignition of the propellant charges so that the sub-projectiles are successively ejected from the barrel. The sub-projectiles (4) are firmly connected with each other in the area of the propellant charges (6, 6') in each case by means of a mechanical connection and the connections have in each case at least one rated break point (7, 7') which is broken in a defined fashion after the ignition of the respective propellant by the pressure of the propellant gases.

13 Claims, 4 Drawing Sheets

U.S. PATENT DOCUMENTS

| | | | | |
|---|---|---|---|---|
| 6,860,187 | B2 * | 3/2005 | O'Dwyer | 89/127 |
| 7,140,301 | B1 * | 11/2006 | O'Dwyer | 102/361 |
| 2003/0127010 | A1 * | 7/2003 | O'Dwyer | 102/335 |
| 2005/0268807 | A1 * | 12/2005 | Bambach | 102/438 |

FOREIGN PATENT DOCUMENTS

| | | | |
|---|---|---|---|
| DE | 199 10 074 | A1 | 3/1999 |
| EP | 1 069 394 | A1 | 3/1994 |
| WO | WO 01/90680 | A1 | 11/2001 |

* cited by examiner

RAPID-FIRE WEAPON

BACKGROUND OF THE INVENTION

The invention relates to a weapon, in particular a rapid-fire weapon.

Such a rapid-fire weapon is e.g. known from U.S. Pat. No. 6,138,395 or EP-A1-1069394. This weapon comprises a barrel and a projectile that is insertable into the barrel and comprises several sub-projectiles that are stacked one behind the other in the longitudinal direction of the barrel and supported on each other, a propellant charge being provided behind each sub-projectile. As a rule, the sub-projectiles are accommodated in a sleeve, the wall of the sleeve being provided with electric igniters in the area of the individual propellant charges. The igniters are successively electrically ignited by means of an ignition means and, due to this, the propellant charges are sequentially ignited so that the sub-projectiles are successively ejected from the barrel.

As a rule, the individual sub-projectiles have a caliber of 40 mm; the fire frequency ranges from 2 to 5 Hz.

Due to the simple stacking of the sub-projectiles in the sleeve, the ejection forces cannot be reproduced in a defined manner for the individual shots. Moreover, the electrical igniters that are always present in the sleeve are susceptible to corrosion and aging and are not safe against electromagnetic interferences which, among other things is a problem for transport and storage.

SUMMARY OF THE INVENTION

The invention is based on the object of modifying the known rapid-fire weapon so that a reliable function of the rapid-fire weapon is achieved, which is reproducible in the entire sequence of the individual shots.

Moreover, it should also be possible to safely store the weapon with all its parts, including the sub-projectiles, for a long period of time and to safely transport it.

For this purpose, it is a first feature of the invention that the sub-projectiles are firmly mechanically connected with each other in the area of the propellant charges, a rated break point being provided in this mechanical connection, which, after igniting the respective propellant charge by its propellant gases is broken in a defined fashion.

A second feature consists in that the propellant charges are in each case ignited by means of pyrotechnical ignition charges, namely by their ignition jet, i.e. by their propellant gases. The ignition jet of an ignition charge enters in each case a ignition duct which penetrates the wall of the barrel and ends in the area of a propellant charge for a specific sub-projectile.

Due to the firm connection of the sub-projectiles by means of a defined rated break point it is achieved that the sub-projectiles are only ejected from the barrel if a very specific pressure of the propellant gases has been developed. Thus, the ejection conditions are identical for each shot so that the sub-projectiles have the same discharge and flight speeds for each shot and, in the case of a fixed alignment of the weapon, always have substantially the same radius of action. A high reproducible target accuracy is also achieved with this.

The mechanical connection of the sub-projectiles with each other also has the further advantage that a separate sleeve for accommodating the sub-projectiles is not required. In order to also create the same conditions for the sub-projectile located "at the rear" in the direction of the shot, it is supported on a blind flange and is also connected with this flange with a defined rated break point through a mechanical connection. This blind flange, in turn, is supported on the end of the barrel and thus holds the individual sub-projectiles with are mechanically connected with each other in a defined position in the barrel. The unit of sub-projectiles that are bolted to each other and the blind flange forms the actual projectile and/or the ammunition.

The igniting of the individual propellant charges by means of the ignition jet of a pyrotechnical ignition charge has the advantage that this ignition can be reproduced with utmost reliability; moreover, electrical contacts in the barrel or in a sleeve for the projectiles, which are susceptible to corrosion and aging are avoided. Moreover, there are no problems regarding electromagnetic interferences.

The pyrotechnical ignition charges are preferably combined to one unit for all sub-projectiles of a projectile, the pyrotechnical ignition charges immersing in each case into a receiving opening in the outer wall of the barrel, from which the ignition duct leading to a propellant charge starts. The individual units may be stored separately from the projectiles so that there are no problems during transport and storage of the ammunition. The units are only slipped onto the barrel when the rapid-wire weapon is used.

Thus, a rapid-fire weapon according to the invention consists of three elements, namely the barrel, the projectile and the unit of ignition charges. These elements are easy to handle and may be separately stored even for a long period of time and substantially transported without any safety risk.

The propellant charges are preferably disposed within a casing at the rear of each sub-projectile, this casing having a rated break point, where the ignition duct ends. This rated break point is punctured by the ignition jet of the respective pyrotechnical ignition charge and then it directly impacts on the propellant charge.

Alternatively it is possible to provide the casing with an annular duct extending in its peripheral direction, at least one branch duct branching off from the annular duct, which extends to the propellant charge. The annular duct may be provided with a cover which is punctured upon the ignition of the pyrotechnical ignition charge. Then, the ignition flame enters the annular duct and the at least one branch duct so that the propellant charge can be reliably ignited.

In order to achieve in each case reproducible pressure conditions during the ignition of the propellant charge when firing a sub-projectile, the sub-projectile to be respectively ejected is supported with its rear on the subsequent sub-projectile in a pressure-tight manner. Thus, the propellant gases of the propellant charge spread in a defined volume till the rated break point is broken.

This pressure-tight supporting can e.g. be implemented so that the rear edge of the casing accommodating the propellant charge is adapted to the shape of the head of the subsequent sub-projectile. Possibly, both the head of the projectile and the rear edge of the casing may be of a slightly toothed design, whereby, till the breaking of the rated break point between two sub-projectiles, the volume for the propellant charge is sealed with a high pressure resistance and remains unchanged. Due to the pressure-tight support it is avoided that propellant gases escape between the subsequent sub-projectile and the inner wall of the barrel, whereby the pressure conditions could be influenced in a disadvantageous manner.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
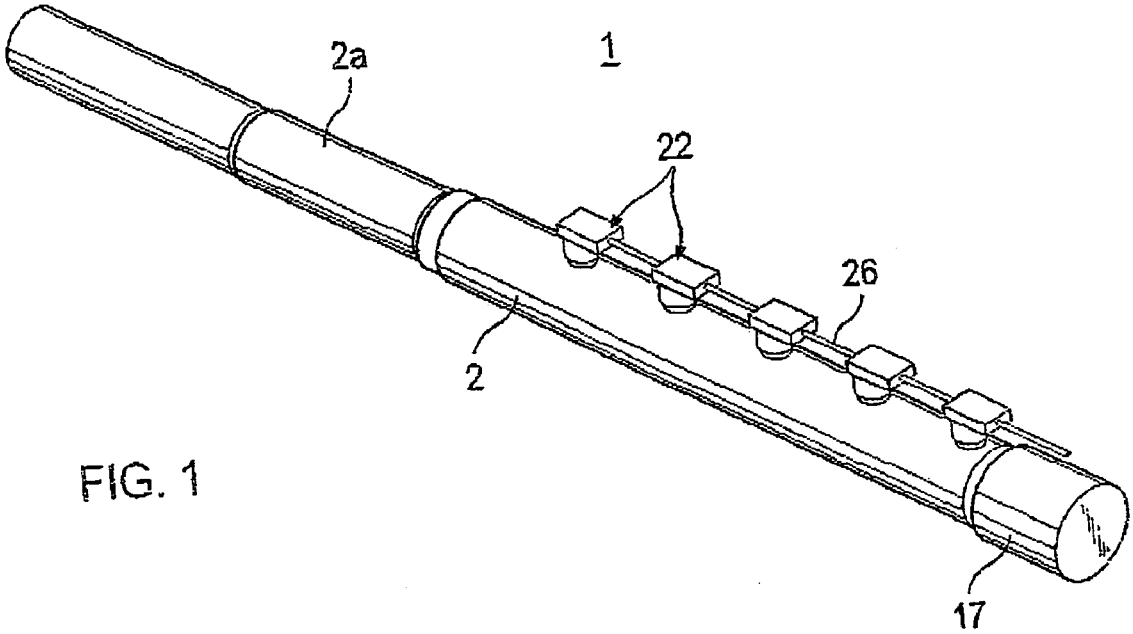
FIG. 1 shows a perspective view of a rapid-fire weapon according to the invention.
Figure 2:
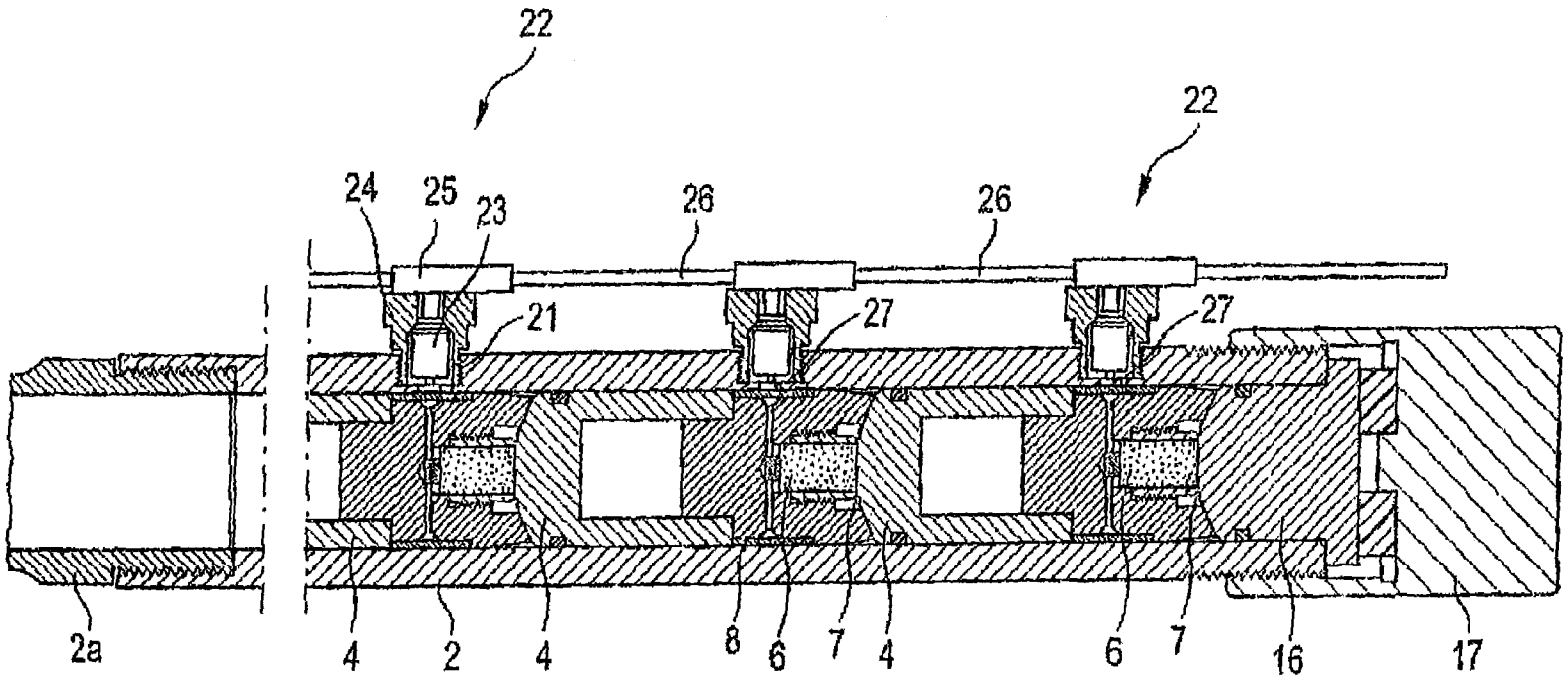
FIG. 2 shows a longitudinal section through a part of the rapid-fire weapon according to FIG. 1 with several sub-projectiles stacked upon each other.

The preferred embodiments of the present invention will now be described with reference to FIGS. 1-5 of the drawings. Identical elements in the various figures are designated with the same reference numerals.

A rapid-fire weapon 1 is shown in FIG. 1 which comprises a barrel 2 into which a projectile 3 (cf. also FIG. 3) consisting of several sub-projectiles 4, in this case five, which are disposed one behind the other, is inserted. Each sub-projectile 4 comprises a sleeve-shaped casing 5 at the rear, into which the housing of an encapsulated propellant charge 6 is centrally screwed in. The encapsulated propellant charge 6 for a sub-projectile is in each case connected with the head of the sub-projectile located behind it, this connection having a ca-ted break point 7 which is broken, upon ignition of the propellant charge, when the propellant gases reach a predetermined pressure.

An annular duct 8 extending in circumferential direction is provided in the front area of the propellant charge 6 on the outer circumference of each sub-projectile, from which several branch ducts 9 branch off in the direction to the longitudinal axis of the sub-projectile 4 and lead to an ignition charge 10 for the propellant charge 6.

The annular duct 8 of each sub-projectile is covered with an extension of a twisted-band 11.

The casing 5 on the rear of each sub-projectile surrounds the encapsulated propellant charge 6 at a distance so that a pressure chaniber 12 is formed between the housing of the propellant charge, the casing and the head of the subsequent sub-projectile. After the propellant charge 6 has been ignited, the propellant gases of the propellant charge 6 enter this pressure chamber via outflow openings 13.

Figure 3:
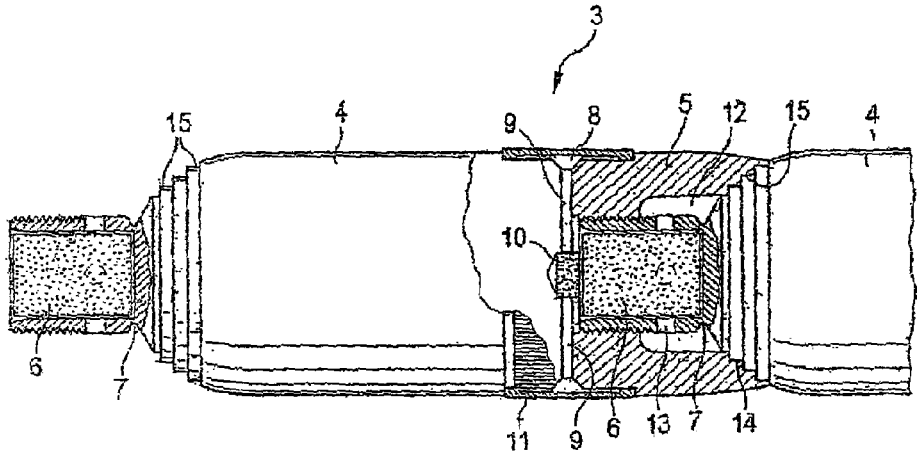
FIG. 3 shows partly sectional view of two sub-projectiles stacked upon each other.

In order to avoid an escape of the propellant gases from this pressure chamber, the casing 5 is supported in a pressure-tight fashion on the ogive, i.e. the head of the subsequent sub-projectile 4. Moreover, it is possible that the rear edge of the casing 5 is adapted to the head shape of the subsequent sub-projectile 4; as is shown in FIG. 3, the rear edge of the casing 5 can also be stepped at 14, the steps of this rear edge engaging into corresponding steps 15 in the head of the subsequent sub-projectile, as this is shown in greater detail in FIG. 3.

The rearmost sub-projectile 4 is supported on a blind flange 16 which abuts against the rear end of the barrel 2 and is connected with the sub-projectile 4 by means of a bolt connection in a fashion similar to the connection of the remaining sub-projectiles to each other, in which a propellant charge 6 is located and which comprises a defined rated break point 7.

Figure 4:
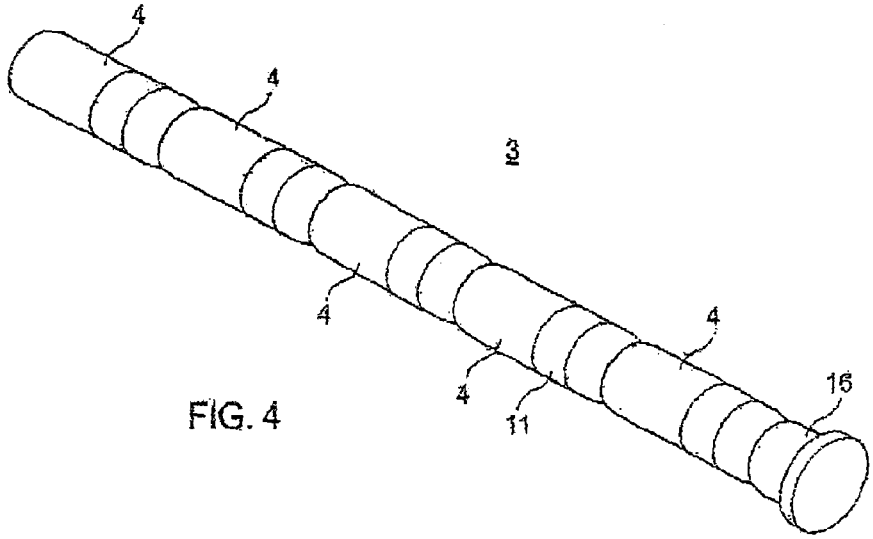
FIG. 4 shows a perspective view of a projectile composed of several sub-projectiles for the rapid-fire weapon.

The entire projectile 3 which is screwed together from five sub-projectiles 4 that are screwed together and the blind flange 16 is shown in FIG. 4. This projectile 3 is inserted into the smooth barrel and held by a spigot nut 16 encompassing the rear end of the barrel.

Several receiving holes 21 for ignition charges 22 are provided in the outer wall of the barrel in its longitudinal direction, these ignition charges having each a pyrotechnical ignition means 23 as they are e.g. known for igniting safety means in motor vehicles such as air bags or belt tighteners and are e.g. described in the European patent 1,000,310 of Applicants. The ignition means 23 have in each case an ignition chamber in a housing that is filled with ignition material. Contact pins project into the ignition chamber, which are connected in the ignition chamber by means of a resistance wire. The ignition means are received in a housing 24 which is insertable in a receiving hole 21. An ignition connector 24 is slipped onto each housing 24, which establishes the electric contact with the contact pins of the individual ignition means. The connectors 25 are connected with each other by means of cables 26, the cable leading to the first ignition connector 25 leading to an ignition means (not shown) which sequentially provides the electric ignition pulses for the individual ignition charges 22. The entire unit consisting of ignition charges, cables and ignition means is only placed onto the barrel when the weapon is used.

An ignition duct 27 leads radially into the interior of the barrel 2 from the bottom of each receiving opening 21 for an ignition charge 22. The ignition duct ends in the area of the annular duct 8 of a sub-projectile 4.

If the individual ignition charges 22 are sequentially ignited, the ignition flame of the respective ignition charge 22 enters the annular duct 8 via the ignition duct 27, the extension of the twist-band 11 being punctured. Then, the ignition flame enters the branch ducts 9 and ignites the ignition charge 10 of the propellant charge 7 which is also ignited by this. After the ignition of the propellant charge the propellant gases flow over the overflow openings into the pressure chamber 12, as well, until such a defined pressure is exerted onto the bottom of the respective sub-projectile 4 that the rated break point 7 between the propellant charge and the subsequent sub-projectile is broken and the front sub-projectile 4 is ejected from the barrel 2.

Figure 5:
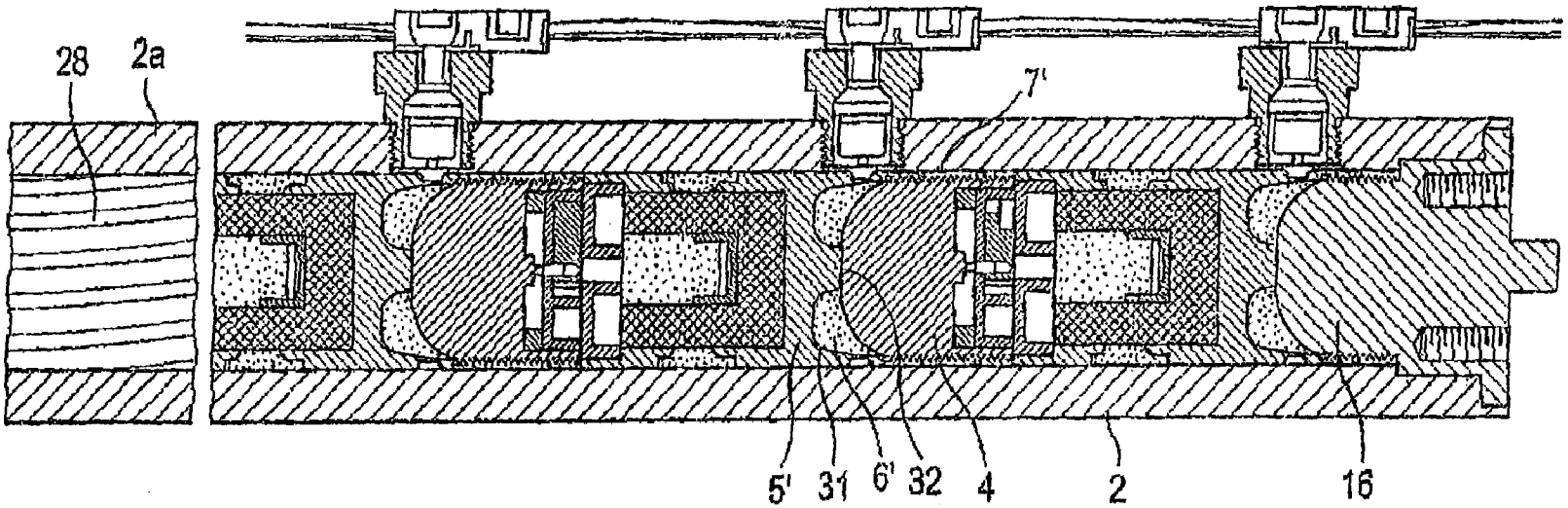
FIG. 5 shows a longitudinal section through a part of a rapid-fire weapon according to a second example of embodiment of the invention.

The area of the barrel 2 in which the sub-projectiles 4 are located is a smooth barrel which is adjoined by a barrel section 2*a* with twist grooves 28 (cf. FIG. 5). As soon as the respective sub-projectile reaches the area 2*a* of the barrel with the twist grooves, they engage the twist-band 11 so that the sub-projectile is caused to rapidly rotate in order to stabilize its flight position.

A second example of embodiment of a rapid-fire weapon 1 is shown in FIG. 5. Again, each sub-projectile 4 comprises a casing 5' at its rear, which has an annular chamber 31 being open towards the rear, in which the propellant charge 6 is mounted. The casing 5' comprises a central anvil 32 with which the respectively foremost sub-projectile is supported on the sub-projectile located behind it.

The casing 5' of each sub-projectile is extended towards the rear and provided with an internal thread which engages into an external thread on the head of the sub-projectile located behind it and/or the blind flange 16'. This thread forms a defined rated break point 7'. In this design, as well, the volume of the propellant charge is defined and limited.

Upon the ignition of the individual ignition charges 22 the casing 5' which is formed with a rated break point 33 that is formed as an annular groove is punctured by the ignition flame of the ignition charge 21 which then directly ignites the propellant charge 6. As soon as the pressure stipulated by the rated break point 7' is reached and the rated break point 7' breaks, the sub-projectile is ejected from the barrel 2 in a controlled manner and with reproducible conditions and is set rotating by the twist grooves 28 in the area 2*a* of the barrel.

There has thus been shown and described a novel rapid-fire weapon which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a weapon, in particular a rapid-fire weapon, having a barrel with a projectile insertable into the barrel, which comprises several sub-projectiles disposed one behind the other in the longitudinal direction of the barrel and supporting each other, a propellant charge being provided behind each sub-projectile, and an ignition means for the sequential ignition of the propellant charges so that the sub-projectiles are successively ejected from the barrel, the improvement wherein:

the sub-projectiles are firmly connected with each other in the area of the propellant charges in each case by means of a mechanical connection;

the connections have in each case at least one break point which is broken after the ignition of the respective propellant charge, when the propellant gases reach a predetermined pressure;

the ignition means comprises for each propellant charge a pyrotechnical charge located outside the barrel, whose propellant gases enter in each case an ignition duct penetrating the wall of the barrel and ending in the area of the propellant charge and ignite the respective propellant charge;

each propellant charge is disposed within a casing on the rear of each sub-projectile, the propellant charge having a housing which is centrally connected within the casing both with the appertaining sub-projectile and with the subsequent sub-projectile;

the break point is located in the connection with the subsequent sub-projectile; and the casing of the propellant charge comprises lateral outflow openings which end in a pressure chamber delimited by the housing of the propellant charge, the casing and the head of the subsequent sub-projectile.

2. A rapid-fire weapon according to claim 1, wherein the mechanical connection between the sub-projectiles is a screw connection.

3. A rapid-fire weapon according to claim 1, wherein the casing at the rear of the sub-projectile is supported with its rear edge on at least one of (1) the subsequent sub-projectile and (2) a blind flange, in a pressure-tight fashion.

4. A rapid-fire weapon according to claim 3, wherein the rear edge of the casing and the subsequent sub-projectile have corresponding meshing teeth.

5. A rapid-fire weapon according to claim 1, wherein the casing of a sub-projectile is extended towards the rear and provided with an internal thread which engages into an external thread on the head of the subsequent sub-projectile, this screw connection forming the break point, and wherein the casing comprises a central anvil which is supported on the head of the subsequent sub-projectile.

6. A rapid-fire weapon according to claim 1, wherein the pyrotechnical ignition charges for all sub-projectiles of a rapid-fire weapon are combined together with cables and the ignition means provide the ignition pulses for the ignition charges to form a structural unit, which can be placed onto the barrel only shortly prior to the use of the weapon.

7. In a weapon, in particular a rapid-fire weapon, having a barrel with a projectile insertable into the barrel, which comprises several sub-projectiles disposed one behind the other in the longitudinal direction of the barrel and supporting each other, a propellant charge being provided behind each sub-projectile, and an ignition means for the sequential ignition of the propellant charges so that the sub-projectiles are successively ejected from the barrel, the improvement wherein:

the sub-projectiles are firmly connected with each other in the area of the propellant charges in each case by means of a mechanical connection;

the connections have in each case at least one break point which is broken after the ignition of the respective propellant charge, when the propellant gases reach a predetermined pressure;

the ignition means comprises for each propellant charge a pyrotechnical charge located outside the barrel, whose propellant gases enter in each case an ignition duct penetrating the wall of the barrel and ending in the area of the propellant charge and ignite the respective propellant charge;

each sub-projectile comprises a continuous annular duct;

at least one branch duct branches off from the annular duct, which leads to the propellant charge; and an ignition duct ends in the area of the annular duct in the barrel, which communicates in each case with a pyrotechnical ignition charge.

8. A rapid-fire weapon according to claim 7, wherein the annular duct is provided with a cover which is broken after the ignition of the ignition charge by the propellant gases thereof.

9. A rapid-fire weapon according to claim 7, wherein the mechanical connection between the sub-projectiles is a screw connection.

10. A rapid-fire weapon according to claim 7, wherein the casing at the rear of the sub-projectile is supported with its rear edge on at least one of (1) the subsequent sub-projectile and (2) a blind flange, in a pressure-tight fashion.

11. A rapid-fire weapon according to claim 10, wherein the rear edge of the casing and the subsequent sub-projectile have corresponding meshing teeth.

12. A rapid-fire weapon according to claim 7, wherein the casing of a sub-projectile is extended towards the rear and provided with an internal thread which engages into an external thread on the head of the subsequent sub-projectile, this screw connection forming the break point, and wherein the casing comprises a central anvil which is supported on the head of the subsequent sub-projectile.

13. A rapid-fire weapon according to claim 7, wherein the pyrotechnical ignition charges for all sub-projectiles of a rapid-fire weapon are combined together with cables and the ignition means provide the ignition pulses for the ignition charges to form a structural unit, which can be placed onto the barrel only shortly prior to the use of the weapon.

* * * * *